US007455284B2

(12) United States Patent
Kotani

(10) Patent No.: US 7,455,284 B2
(45) Date of Patent: Nov. 25, 2008

(54) PAPER ALIGNMENT DEVICE AND PAPER POST-PROCESSING DEVICE EQUIPPED WITH THE SAME

(75) Inventor: Takashi Kotani, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 278 days.

(21) Appl. No.: 11/258,902

(22) Filed: Oct. 27, 2005

(65) Prior Publication Data

US 2007/0170634 A1 Jul. 26, 2007

(51) Int. Cl.
*B65H 37/04* (2006.01)

(52) U.S. Cl. ..... 270/58.04; 270/58.11; 270/58.12; 270/58.17; 270/58.27

(58) Field of Classification Search ..... 270/58.04, 270/60, 58.07, 58.08, 58.09, 58.11, 58.12, 270/58.17, 58.27
See application file for complete search history.

(56) References Cited

U.S. PATENT DOCUMENTS 6,227,530 B1 * 5/2001 Namba et al. ..... 270/58.09
6,381,443 B1 * 4/2002 Kawata et al. ..... 399/407
6,575,446 B2 * 6/2003 Wakabayashi et al. ... 270/58.07

* cited by examiner

*Primary Examiner*—Gene Crawford
*Assistant Examiner*—Leslie Nicholson, III
(74) *Attorney, Agent, or Firm*—Global IP Counselors, LLP

(57) ABSTRACT

A device which aligns bundles of paper Q with a predetermined number of A4 paper PA4 as small size paper and A3 paper PA3 as large size papers formed by successively receiving paper P fed from image forming device 19, comprising a stacking unit 30 as a main retaining device which aligns and retains in a stacked condition paper P successively received from the image forming device 19, a paper detour retaining device 20 as a preliminary retaining device located directly upstream of the main retaining device stacking unit 30, which temporarily retains the paper P destined to the stacking unit 30, and a controller which controls feeding to the stacking unit 30 by temporarily retaining the A4 paper PA4 paper, and combining the retained A4 paper PA4 with the large size paper A3 paper PA3 before sending to the stacking unit 30 in an overlaid condition.

12 Claims, 8 Drawing Sheets

PAPER ALIGNMENT DEVICE AND PAPER POST-PROCESSING DEVICE EQUIPPED WITH THE SAME

FIELD OF THE INVENTION

The present invention relates to a paper alignment device which aligns paper fed from an image forming device such as a printer, and a paper post-processing device equipped with the same.

BACKGROUND INFORMATION

Conventionally, paper post-processing devices are commonly known for post-processing of paper fed from an image forming device. These paper post-processing devices receive and properly align paper which has been fed into a retaining device from an upstream image forming device, performs post-processing such as stapling when each unit (one set) of paper has been compiled, and then discharges the set.

However, with a normal post-processing device, the pitch of paper fed from the image forming device can be aligned upon receipt of each sheet of paper, but a great deal of time is lost when stapling multiple sheets of paper when a unit of predetermined number of pages has been retained in the retaining device, so handling each sheet of paper successively fed from the image forming device is not possible, and therefore the image forming process of the image forming device is commonly interrupted temporarily in order to relieve this condition. However, this causes the image forming process to be temporarily interrupted, and as result the efficiency will be lower for the image forming process including post-processing.

In contrast, the paper post-processing device of another conventional technology temporarily stores the first few sheets of paper from a set of paper which has been fed from the image forming device on the circumferential surface of a separate detour drum which acts as a second retaining device, and during this time, stapling is performed on a paper bundle which is one set of paper retained in the retaining device. The plurality of sheets of paper stored and retained on the detour drum are combined with the next sheet of paper fed from the image forming device and supplied to the empty retaining device where stapling of the previous paper bundle has been completed. By using this measure, the need to interrupt temporarily the image forming process is eliminated, and the processing efficiency for the image forming device can be increased.

However, if a paper of different size is included in the set of papers to form a so-called mixed bundle, a paper support member attached to a vertically angled retaining device which receives the bottom edge of the paper, must be raised or lowered depending on the size of the paper. Time is required for raising and lowering, and therefore synchronizing with the paper fed at a predetermined pitch from the image forming device is difficult.

In view of the above, an object of the present invention is to provide a paper alignment device which can perform post-processing of papers even with mixed sizes without a drop in processing efficiency, and to provide a paper post-processing device equipped with the same.

SUMMARY OF THE INVENTION

The invention according to a first aspect is a paper alignment device which can align bundles of paper with a predetermined number of small size papers and large size papers formed by successively receiving paper fed from an upstream device, comprising a main retaining device which aligns and retains in a stacked condition paper successively received from the upstream device, a preliminary retaining device located directly upstream of the main retaining device, which temporarily retains the paper destined to the main retaining device, and a control unit which controls feeding to the main retaining device by temporarily retaining the small size paper, and combining the retained small size paper with the large size paper before sending to the main retaining device in an overlaid condition.

With this construction, if one set of paper is a so-called mixed size bundle where small size paper and large size paper are mixed together, the small size paper will be temporarily retained in the preliminary retaining device, and then fed to the main retaining device overlaid together with the large size paper. Therefore the problem can be eliminated where, when paper of different sizes are individually sent to the main retaining device, preparation for receiving according to the size are necessary and the paper feed pitch of the upstream device must be delayed because of this time loss. For instance, even if one set of paper has mixed sizes, the paper can still be fed at a preset pitch specific to the upstream device.

The invention according to a second aspect is the invention according to the first aspect, wherein the control unit is comprising a paper bypass instructing unit which determines whether to cause paper to be retained by the preliminary retaining device or to be sent to the main retaining device, depending on the type and condition of the paper, and which outputs a control signal to a designated switching means which switches the destination of the paper.

With this construction, the paper bypass instructing unit outputs a control signal to the switching means which switches the paper destination depending on the paper type and condition, and thereby the paper is sent to the paper destination based on the type and condition of the paper by the switching function of the switching means.

The invention according to a third aspect is a paper post-processing device for successively receiving paper fed from an upstream device and for performing predetermined post-processing, wherein the paper alignment device according to any one of the first to third aspects aligns paper as a post-process, is built-in.

With this construction, the post-processing device may fully have the effects of the paper alignment device according to the first or second aspect.

The invention according to the fourth aspect is the invention according to the third aspect,equipped with a size sensor for detecting the paper size With the invention according to the first aspect, the conventional problem can be eliminated where, when paper of different sizes are individually sent to the main retaining device, preparation for receiving according to the size is necessary and the paper feed pitch of the upstream device must be delayed because of this time loss. For instance, even if one set of paper has mixed sizes, the paper can still be fed at a preset pitch specific to the upstream device, and overall paper processing efficiency can be increased.

With the invention according to the second aspect, the paper bypass instructing unit outputs a control signal to the switching means which switches the paper destination depending on the type and condition of the paper, and therefore the paper can be sent to the proper destination depending on the type and condition of that paper by the switching action of the switching means which received the control signal.

With the invention according to the third aspect, a post-processing device can be made to have the full effects of the function of the paper alignment device according to the first or second aspect.

With the invention according to the fourth aspect, the post-processing device can independently detect the size of the paper without that information being input from the upstream device, and therefore there is no need to consider measures for transmitting the signal for the size information from the upstream device, and therefore the post-processing device installation can be accomplished with more freedom.

DETAILED DESCRIPTION OF THE PREFERRED EMBODIMENTS

Figure 1:
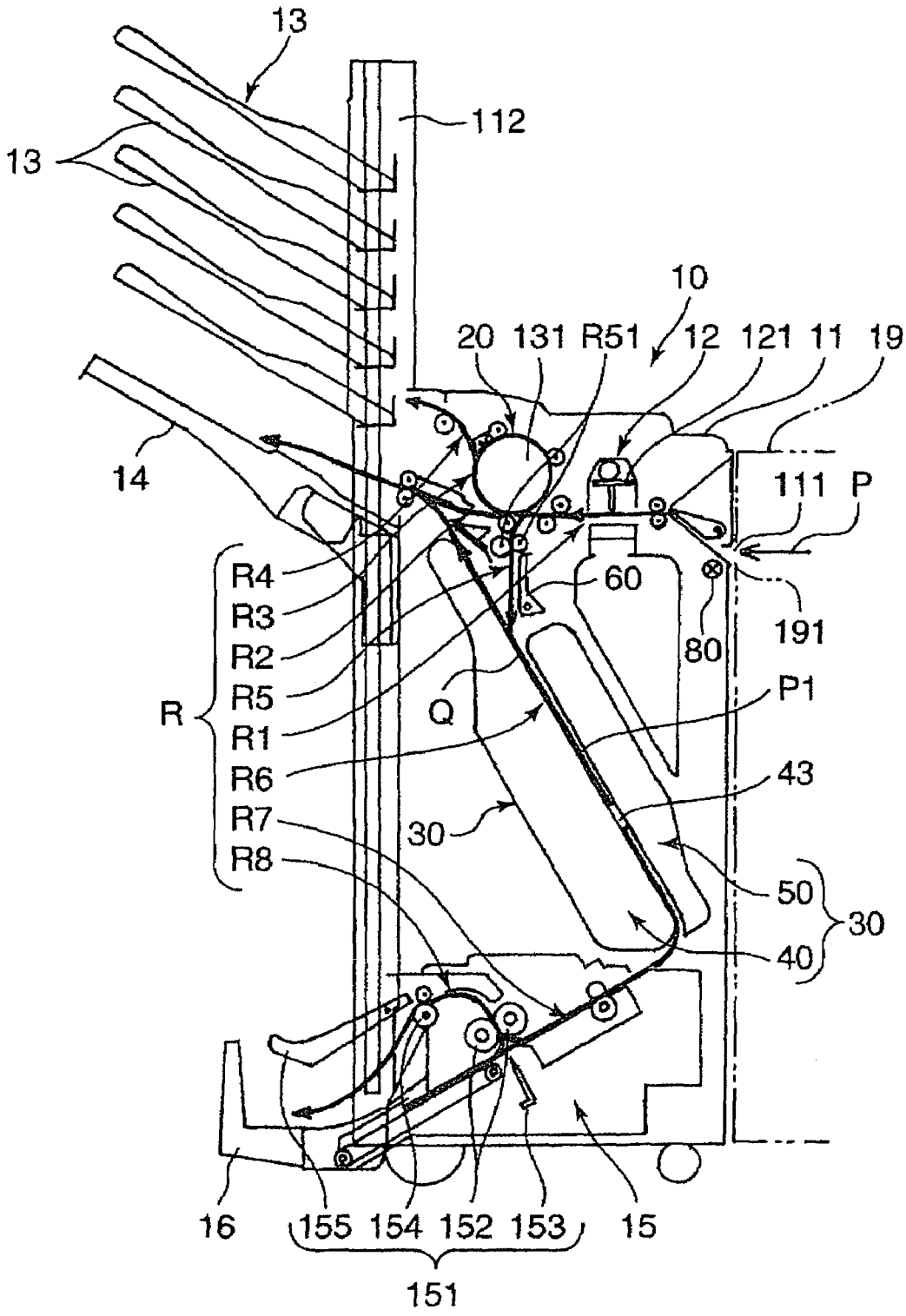
FIG. 1 is side view explanatory diagram for describing the internal structure of an embodiment of the post-processing device of the present invention.

FIG. 1 is a side view explanatory diagram for describing the internal mechanism of an embodiment of a paper post-processing device equipped with the paper alignment device of the present invention. As shown in this diagram, a paper post-processing device 10 is placed next to an image forming device (upstream device) 19 which is used as a copier, fax machine, or a type of printer, wherein a rectangular box-like housing 11 houses a punching unit 12 for punching holes for binding a paper P along a paper transport path R, a paper detour retaining device (preliminary retaining device) 20, located downstream (to the left in FIG. 1) from the punching unit 12, which separates the paper P by destination, a stacking unit 30 located beneath the paper detour retaining device 20 which temporarily retains bundles of paper P (paper bundle Q) which have been discharged, and staples the paper bundle Q in order to bind the paper bundle Q, and a center folding unit 15 which applies a centerfold to the paper bundle Q after stapling.

On the other hand, on the outside of the housing 11 are job trays 13 which stand up from the backside, a common tray 14 located beneath the job trays 13, and a center fold tray 16 located on the bottom part of the housing, facing toward the common tray 14. The job trays 13 and the common tray 14 are for when paper P or paper bundle Q is discharged without being center folded, while center fold tray 16 is for paper bundles Q which are discharged having been center folded by the center folding unit 15.

The paper transport path R is comprising: an intake side transport path R1 in the upper right hand corner of the housing 11 in FIG. 1, from a paper receiving opening 111 for receiving paper P discharged from a discharge port 191 of an image forming device 19 to a paper detour retaining device 20; a common tray transport path R2 which proceeds directly from the intake side transport path R1 to the common tray; a ring transport path (preliminary retaining device) R3 which branches upward from the common tray transport path R2 and is formed by the paper detour retaining device 20; a job tray transport path R4 which branches upward from partway along the ring transport path R3 to reach the job trays 13; a stacking unit transport path R5 suspended down from the paper detour retaining device 20 to the stacking unit 30; a stacking unit internal transport path (main retaining device) R6 which is formed to pass vertically through the stacking unit 30; a center folding unit internal transport path R7 which is formed to pass through the center folding unit 15 at an angle in a manner which can be connected with the stacking unit internal transport path R6; and a center folding discharge transport path R8 for discharging paper bundles Q which have been center folded in the center folding unit 15.

The punching unit is located above the intake side transport path R1. The punching unit has an internal punching mechanism 121 which raises and lowers a punching blade, and the paper P introduced to the intake side transport path R1 has punch holes opened at predetermined locations by raising and lowering the punching blade by driving the punching mechanism 121 when the paper transport has momentarily stopped.

Figure 2:
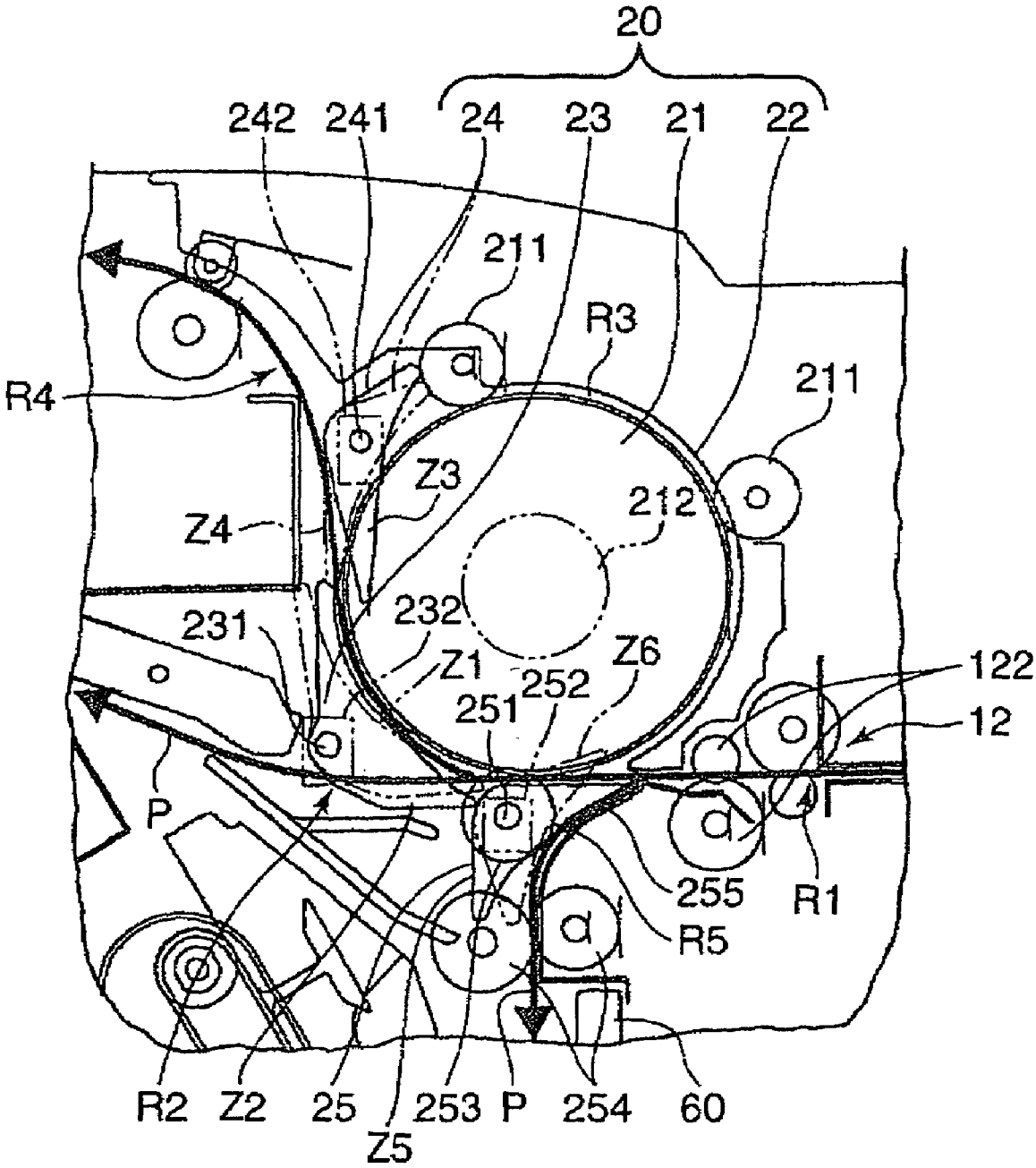
FIG. 2 is a side view explanatory diagram showing an embodiment of a paper detour retaining device.
Figure 3A:
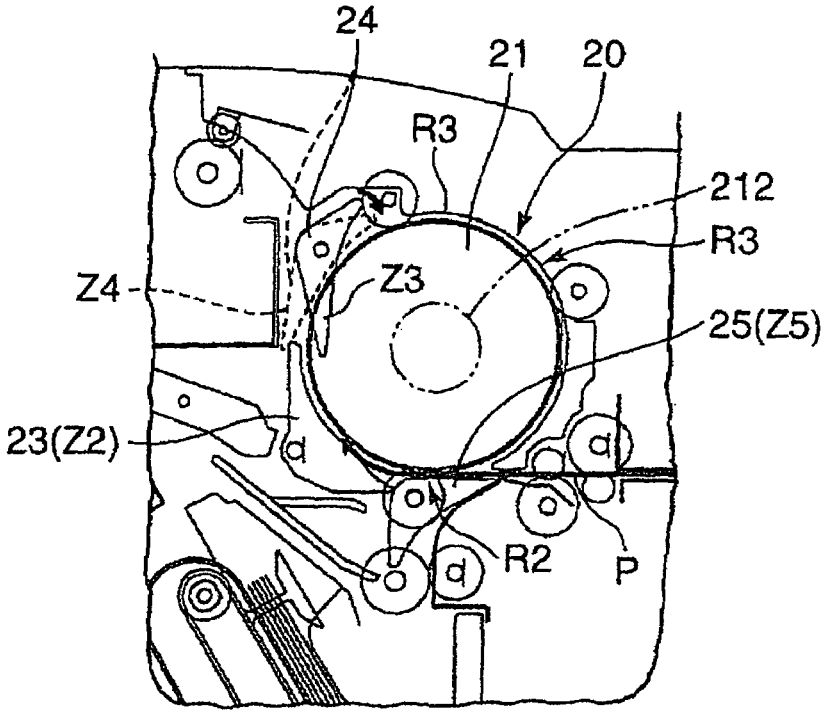
FIG. 3A-FIG. 3B are explanatory diagrams for describing the detour retaining function of the paper detour retaining device shown in FIG. 2, where (A) shows the condition while the paper P is being inserted into the paper detour retaining device, and (B) shows the condition where the detoured paper P is being discharged from the paper detour retaining device.
Figure 3B:
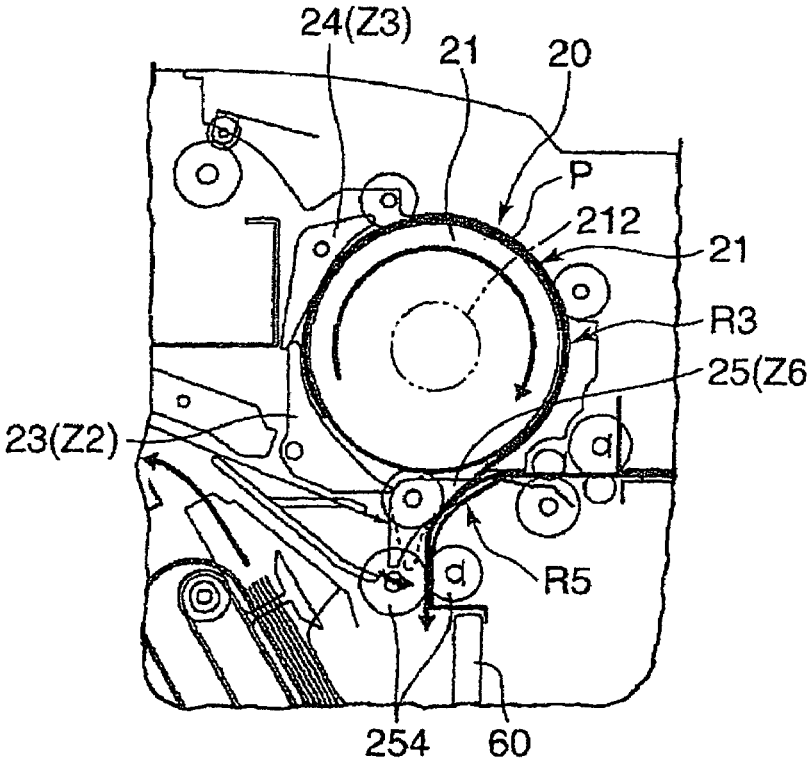

FIG. 2 is a side view explanatory diagram showing an embodiment of the paper detour retaining device 20. Furthermore, FIG. 3A-FIG. 3B are explanatory diagrams for describing the detour retaining function of the paper detour retaining device shown in FIG. 2, where (A) shows the condition while the paper P is being inserted into the paper detour retaining device 20, and (B) shows the condition where the stored paper P is being discharged from the paper detour retaining device 20.

First, as shown in FIG. 2, the paper detour retaining device 20 is located above the immediate downstream side of the common tray transport path R2 which is on the downstream side (toward left in FIG. 2) of the intake side transport path R1, and is comprising a cylindrical detour drum 21 (circular body) with a center axis which extends in the paper lateral direction orthogonal to the paper transport direction, and an arc shaped cover 22 over approximately the right half of this device 21 as shown in FIG. 2 with a predetermined gap therebetween, a first switching guide 23 which covers the lower left region of the detour drum 21 as shown in FIG. 2, and a second switching guide 24 which covers the upper right [should probably read upper left] region of the same. Furthermore, the ring transport path R3 is formed by the circular gap formed between the outer circumferential surface of the detour drum and the inside surface of the arc-shaped cover 22, first switching guide 23, and second switching guide 24.

A predetermined number of bypass rollers 211 are established in locations opposite to appropriate places on the outer circumferential surface of the detour drum 21, and paper P which is introduced to the ring transport path R3 proceeds forward, held between the outer circumferential surface of the bypass rollers 211 and the outer circumferential surface of the detour drum 21.

Furthermore, the detour drum 21 can be rotationally driven around the center axis of the drum by driving a drum motor 212. Furthermore, the paper P which detours into the ring transport path R3 is discharged through the stacking unit transport path R5 to the stacking unit internal transport path R6 by the clockwise rotation which is driven by the drum motor 212. The detour drum 21 is able to retain a plurality of papers P.

The first switching guide 23 is axially supported to freely rotate around a first axis 231 which extends in the paper lateral direction orthogonal to the paper transport direction slightly above the common tray transport path R2, and is able to change position between a common tray target position Z1 (shown by the double dotted line in FIG. 2) which guides the paper P to the common tray transport path R2, and a ring transport path target position Z2 (shown by the solid line in FIG. 2) which guides the paper P to the ring transport path R3.

The second switching guide 24 is axially supported to freely pivot around a second axis 241 which extends in the paper lateral direction orthogonal to the paper transport direction slightly above the branching point for the job tray transport path R4 in the ring transport path R3, and is able to change position between a job tray target position Z3 (shown by the solid line in FIG. 2) which guides the paper P to the job tray transport path R4 and a ring transport path target position Z4 (shown by the double dotted line in FIG. 2) which guides the paper P to the ring transport path R3.

Furthermore, the first switching guide 23 changes position between the common tray target position Z1 and the ring transport path target position Z2 by being driven forward or back by a first actuator 232 using a solenoid or the like, and the second switching guide 24 also changes position between the job tray target position Z3 and the ring transport target position Z4 by being driven forward or back by a second actuator 242 using a solenoid or the like.

Furthermore, just below the detour drum 21 is an intake unit switching guide 25 which switches the destination of paper P fed from the intake side transport path R1 through a first transport roller pair 122 to either the common tray transport path R2 or the stacking unit transport path R5. This intake unit switching guide 25 is formed as a right triangle with an arc shaped hypotenuse, and is able to switch between a common tray target position Z5 (shown by the solid line in FIG. 2) which guides the paper P to the common tray transport path R2, and a stacking unit target position Z6 (shown by the double dotted line in FIG. 2) which guides the paper P to the stacking unit transport path R5 by the forward and back drive around an input side axle 251 which runs parallel to the first axis 231 by the forward and backward drive of the intake side actuator (switching means) 252.

The intake side axle 51 axially supports a guide roller 253 and a second transport roller pair 254 is located directly beneath the guide roller 253. An arc guide plate 255 which contacts with the guide roller 253 circumferential surface and has a convex arc facing towards the upper left in FIG. 2 is established between the nip region of the second transport roller pair 254 and the nip region of the first transport roller pair 122. Paper P which has passed through the first transport roller pair 122 is lowered to the stacking unit transport path R5 while being held between the arc guide plate 255 and the intake unit switching guide 25. When the intake unit switching guide 25 is in the stacking unit target position Z6, the paper P is introduced to the stacking unit internal transport path R6 through the second transport roller pair 254.

Therefore, when paper P which has been sent from the punching unit 12 is to be moved toward the stacking unit internal transport path R6, the intake unit switching guide 25 will be set in the stacking unit target position Z6. Thereby the paper P from the punching unit 12 will be guided by the intake unit switching guide 25 which is set in the stacking unit target position Z6, and will be introduced to the stacking unit internal transport path R6 through the stacking unit transport path R5 and second transport roller pair 254.

In contrast, when the intake unit switching guide 25 is set to the common tray target position Z5, the paper P which has been sent from the punching unit 12 to the paper detour retaining device 20 will be discharged through the common tray transport path R2 to the common tray 14 if the first switching guide 23 is set to the common tray target position Z1, but will be sent to the ring transport path R3 as shown in FIG. 3A if the first switching guide 23 is set to the ring transport target position Z2.

Furthermore, the paper P fed to the ring transport path R3 by setting the first switching guide 23 to the ring transport target position Z2 is guided by the second switching guide 24 and sent to the job trays 13 when the second switching guide 24 is set to the job tray target position Z3, but if the second switching guide 24 is set to the ring transport target position Z4, the paper P will be guided by the second switching guide 24, introduced to the far side of the ring transport path R3, and will be temporarily stored while wrapped around the detour drum 21.

When the paper P which has been temporarily stored in the ring transport path R3 is discharged toward the stacking unit internal transport path R6, the intake unit switching guide 25 will be set to the stacking unit internal transport path R6. In this condition, as shown in FIG. 3B, the paper P retained on the ring transport path R3 is discharged from the ring transport path R3 of the detour drum 21 by driving the drum motor 212 , passes through the stacking unit transport path R5 while being guided by the intake unit switching guide 25, and is sent through the second transport roller pair 254 to the stacking unit internal transport path R6.

Returning again to FIG. 1, the job tray 13 comprises a plurality of unit trays 131 which are vertically aligned at a predetermined interval, and depending on the job type, any of the unit trays 131 may be selected. In order to make a selection, the job tray 13 is constructed to be able to move up and down along a support pillar 112 which stands vertically on the left-hand side of the housing 11 as shown in FIG. 1, and when the desired unit tray is selected, the base end of this unit tray 131 is set to a position opposite the downstream end of the job tray transport path R4. Therefore, the paper P which has been discharged through the job tray transport path R4 will be discharged to the preselected unit tray 131.

The common tray 14 is for papers P and paper bundles Q for which a discharge target unit tray 131 of the job trays 13 has not been selected in particular, or in other words, the common tray 14 receives standard paper P which has been discharged through the common tray transport path R2 and paper bundles Q which have not had predetermined post-processing in the stacking unit internal transport path R6. When paper P and paper bundles Q are discharged to the common tray 14, the base and of the tray is set to a high position opposite of the downstream end of the common tray transport path R2.

Figure 4:
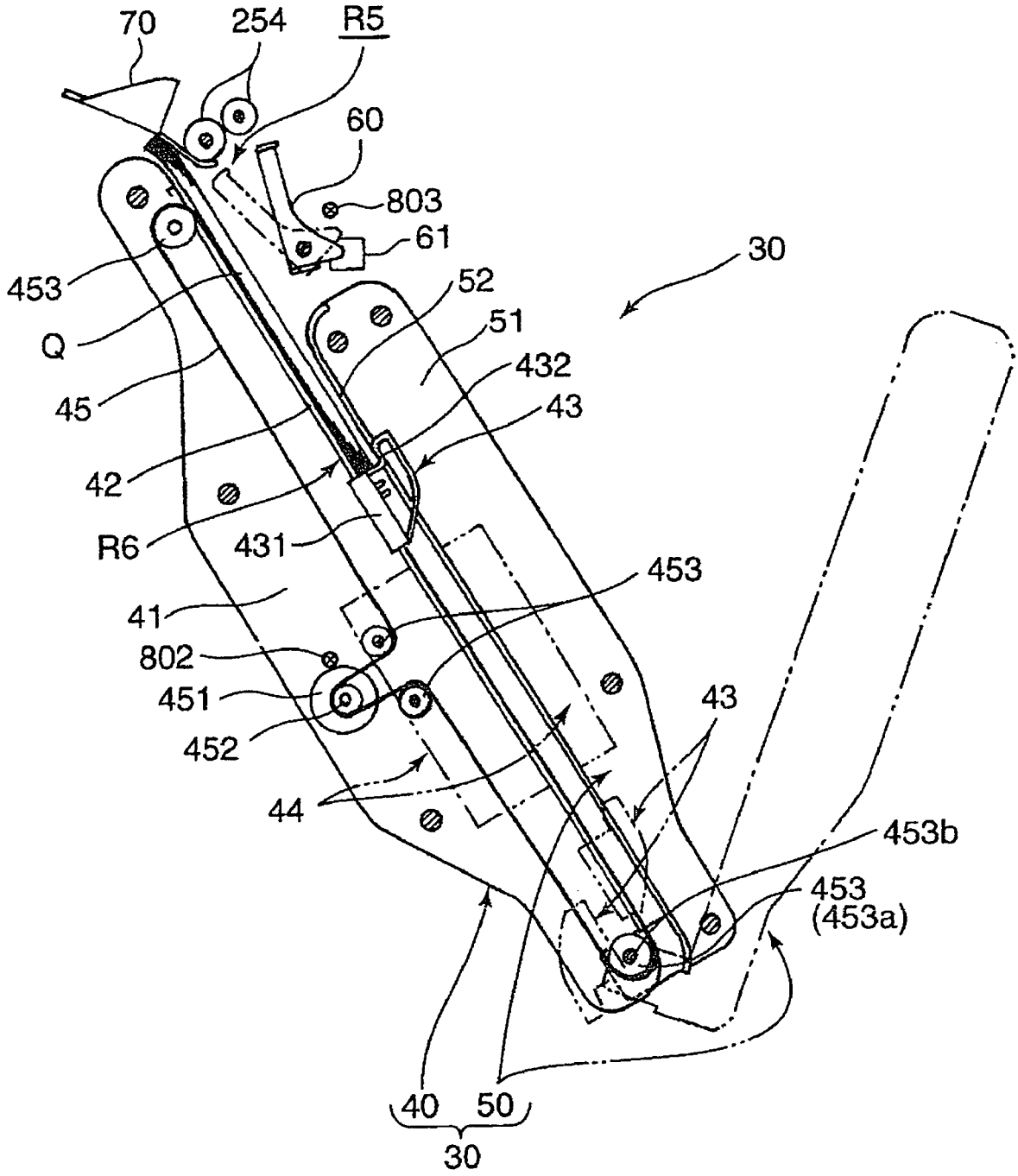
FIG. 4 is a side view explanatory diagram showing an example of a stacking unit position.

Next, the stacking unit 30 will be described based on FIG. 4. FIG. 4 is a side view explanatory diagram showing an embodiment of a stacking unit 30. As shown in the figure, the stacking unit 30 temporarily retains paper P successively fed through the stacking unit transport path R5 to the stacking unit internal transport path R6, aligns the end of the paper bundle Q that is formed, and performs binding, or so-called stapling, of the paper bundle Q. The stacking unit transport path R5 is positioned so that the downstream end faces slightly higher than the center position of the stacking unit internal transport path R6, and the top of the stacking unit internal transport path R6 is facing the common tray transport path R2.

Therefore, the paper P which was temporarily introduced to the stacking internal transport path R6 through the stacking unit transport path R5 is formed into a paper bundle Q and stapled. The stapled paper bundle Q is discharged from the top of the stacking unit internal transport path R6 through the common tray transport path R2 to the common tray 14. Incidentally, the stacking unit 30 will be described later based on FIG. 3A-FIG. 3B.

The center folding unit 15 is the unit which performs so-called center folding, or in other words folds at the center region the paper bundle Q which has been stapled in the center region in the stacking unit 30, and contains a center folding sub-unit 151.

The center folding sub-unit 151 comprises a center folding roller pair 152 established in the center top region of the center folding unit internal transport path R7, a plate-like pressing die 153 which faces the center folding roller pair 152 beneath the center folding unit internal transport path R7 and transverses the center folding unit internal transport path R7, a discharge roller pair 154 established downstream of the center folding discharge transport path R8, and a pressing member 155 which can pivot around a predetermined axis downstream of the discharge roller pair 154.

When a paper bundle Q is introduced to the center folding unit internal transport path R7, the pressing die 153 pushes the stapled region in between the center folding roller pair 152 by means of a driving means omitted from the figure. Therefore, the paper bundle Q is pressed in the center region by the pressing die 153 to make a center fold, and the folded paper bundle Q is pulled into the center folding discharge transport path R8 by the action of the center folding roller pair 152, and is discharged through the center folding discharge transport path R8, the discharge roller pair 154, and the pressing member 155 to be discharged to the center fold tray 16.

Next, the stacking unit 30 will be described based on FIG. 4 while referring to FIG. 1 as necessary. FIG. 1 is a schematic side view diagram showing an embodiment of the stacking unit 30. As shown in FIG. 4, the stacking unit 30 comprises a receiving unit 40 which receives the paper P from the stacking unit transport path R5, and a cover unit 50 which covers the paper receiving surface of the receiving unit 40. The receiving unit 40 comprises paper receiving plates 42 which receive the paper P located between a pair of side plates 41 positioned on an incline in the lateral direction (direction orthogonal to the paper surface in FIG. 4) with the length set such that the upper end faces the common tray transport path R2 and the lower end is located in the lower right hand region of the housing 11, a paper lifting and lowering member (paper receiver) 43 which moves a paper bundle Q which has been received on the paper receiving plate 42 up and down between a upper position and a lower position along the paper receiving plate 42, a stapling mechanism 44 located near the center in the vertical direction between the side plates 41, with a lifting and lowering endless belt which lifts and lowers the paper lifting and lowering member 43 along the paper receiving plate 42.

A plurality of paper receiving plates 42 are lined in the lateral direction and the lifting and lowering endless belt 45 is arranged to fit into the gap between these aligned paper receiving plates 42. The paper lifting and lowering member 43 is held in place by the lifting and lowering endless belt 45 established between these paper receiving plates 42 and is lifted and lowered along the paper receiving plates 42 by the forward and backward rotation of the lifting and lowering endless belt 45. The paper lifting and lowering member 43 comprises a fixed member 431 with a U-shaped lateral side view which is fixed to the lifting and lowering endless belt 45 in a straddle condition, and a paper bundle receiving unit 432 which receives the paper bundle Q and is integrally connected to the fixed member 431. The paper bundle receiving unit 432 has an L-shaped lateral side view, and this L-shaped region receives the paper P introduced to the stacking unit internal transport path R6.

The stapling mechanism 44 (FIG. 4) staples the paper bundle Q which is supported by the paper lifting and lowering member 43 between the receiving unit 40 and the cover unit 50, and comprises a staple supply mechanism for staples and a driving mechanism which drives a supplied staple into the paper bundle Q.

As shown in FIG. 4, the lifting and lowering endless belt 45 loops around a predetermined number of belt support rollers located between the pair of side plates 41, and is rotated by being driven by a belt motor 451 established approximately in the center region in the longitudinal direction between the side plates 41. The belt support rollers included a drive roller 452 concentrically fixed to the drive shaft of the belt motor 451, and a predetermined number of support rollers established between the pair of side plates 41 at the top and, the bottom end, and at various positions between the pair of side plates 41 so that the lifting and lowering endless belt 45 can wrap around the drive roller 452.

Therefore, the lifting and lowering endless belt 45 rotates in the forward and backward direction between the various support rollers 453 by means of the drive roller 452 which is driven forward and backward by the belt motor 451, and thereby the paper lifting and lowering member 43 which is connected to the lifting and lowering endless belt 45 will be lifted and lowered along the paper receiving plate 42.

Furthermore, as shown in FIG. 4, the paper lifting and lowering member 43 can move from a paper bundle support position between the receiving unit 40 and the cover unit 50 to a detour location which is at the bottom position between the pair of side plates 41 by means of the lowest roller 453*a* located at the lowest position of the support rollers 453. Furthermore, the stacking unit internal transport path R6 is connected to the center folding unit internal transport path R7 when the paper lifting and lowering member 43 is in the detour position, and thereby the paper bundle Q, which has been stapled for center folding (center region of the paper bundle Q has been stapled) by the stapling mechanism 44, can be sent to the center folding unit internal transport path R7.

A cover unit 50 covers the receiving unit 40 in order to guide the lifting and lowering of the paper bundle Q, which is formed by the paper P that is discharged to the stacking unit internal transport path R6, to face the paper receiving plates 42 of the receiving unit 40, and comprises a pair of side plates 51 in the lateral direction (directional orthogonal to the paper surface in FIG. 4), and a cover plate 52 which is established between the pair of side plates 51 facing the paper receiving plates 42 of the receiving unit 40.

The cover unit 50 is axially supported to be able to pivot around the roller shaft 453*b* which axially supports the bottom roller 453*a*, and can change positions between a closed position shown by the solid line in FIG. 4 where the stacking unit internal transport path R6 is closed, and an open position shown by the double dotted line in FIG. 4 where the stacking unit internal transport path R6 is open, by the forward and backward rotation around this roller shaft 453*b*.

Furthermore, as shown in FIG. 4, the present invention has a biasing member 60 located behind (right side in FIG. 4) the stacking unit transport path R5 nearly directly below the second transport roller pair 254 which angles upward to the top end of the cover unit 50, and a position retaining member 70 located in front of the front roller of the second transport roller pair 254 and which is located above the biasing member 60.

The biasing member 60 is for biasing the back edge (top edge) of the paper P, which has been discharged through the second transport roller pair 254 to the stacking unit internal transport path R6, to the paper receiving plates 42 of the receiving unit 40. When this biasing is applied, the top edge of the paper bundle Q will be guided between the position retaining member 70 and the paper receiving plates 42 by lifting and lowering the paper lifting and lowering member 43, and thereby the paper P which has just arrived at the stacking unit internal transport path R6 will not interfere with the paper P which will be sent next.

Furthermore, with the present invention, the paper P sent from the image forming device 19 is temporarily stored in the paper detour retaining device 20 under predetermined conditions and combined with the next paper P sent from the paper forming device 19 and introduced to the stacking unit 30 in order to relieve the unbalance in the timing between the predetermined post-processing (stapling in this embodiment) of one paper bundle Q and the timing for feeding paper because of the predetermined transport pitch from the image forming device 19 to the paper post-processing device 10 (or in other words in order to match the timing for both).

In other words, when a plurality of paper P of the same size is steadily fed successively from the image forming device 19 to the paper post-processing device 10, the position of the paper lifting and lowering member 43 which receives the paper P in the stacking unit 30 will not need to be changed, so the pitch of the paper sent from the image forming device 19 can be matched with the pitch that the paper P, which is received by the paper post-processing device 10, is introduced to the stacking unit 30.

However, when one paper bundle Q is formed in the stacking unit 30 and this paper bundle Q is to be stapled, the paper lifting and lowering member 43 must be moved to the predetermined position and the stapling mechanism 44 must be driven, which requires a lot of time, and this cannot be compensated for by the preset paper feed pitch of the image forming device 19.

Therefore, with the present embodiment, when changing receipt of paper P from one paper bundle Q to paper P of the next paper bundle Q, the first plurality of pages (normally about two pages) of the next paper bundle Q are temporarily detoured to the paper detour retaining device 20 without introducing into the stacking unit internal transport path R6 of the stacking unit 30, during which time the previous paper bundle Q is stapled and discharged to the common tray 14 by lifting the paper lifting and lowering member 43, and thereby the next paper P sent from the image forming device 19 is fed to the empty stacking unit internal transport path R6 together with the detoured paper P. Therefore the feed pitch of paper P from the image forming device 19 will not need to be changed, and problems with the processing efficiency for the image forming process of the image forming device 19 being reduced by post-processing can be eliminated.

Furthermore, if the paper bundle Q is a so-called mixed size bundle which combines different sizes of paper P, the timing that paper P can be received into the stacking unit 30 will vary greatly even though the feed pitch from the image forming device 19 does not change much. For instance, if an A3 size of paper P (A3 paper P PA3) is sent from the image forming device 19 to the paper post-processing device 10 after an A4 size of paper P (A4 paper P PA4) has been sent, the paper lifting and lowering member must be lowered so that the position of the paper lifting and lowering member 43 which has been set for the A4 paper PA4 is at the position for the A3 paper PA3, prior to receipt of the A3 paper PA3 into the stacking unit 30. Much time is required for lowering the paper lifting and lowering member 43, and can therefore not be compensated for by the preset paper feed pitch from the image forming device 19.

Therefore, with the present embodiment, if the paper bundle Q to be processed is a mixed size bundle, the position of the paper lifting and lowering member 43 is set before hand to a position which can accommodate A3 paper PA3, and when A4 paper PA4 is fed from the image forming device 19, the A4 paper PA4 is temporarily detoured to the paper detour retaining device 20 without being sent to the stacking unit 30, in order to make time for the paper lifting and lowering member 43 to be raised to the height for A4 paper PA4. Furthermore, when the next paper P (either A4 paper PA4 or A3 paper PA3) is sent from the image forming device 19 to the paper post-processing device 10, the A4 paper PA4 which has been detoured to the paper detour retaining device 20 will be combined with the next paper P and fed to the stacking unit 30. Thereby, the feed pitch for paper P from the image forming device 19 will not need to be changed, and problems with the processing efficiency of the image forming process of the image forming device 19 being reduced because of post-processing can be eliminated.

Figures 5A, 5B, 5C:
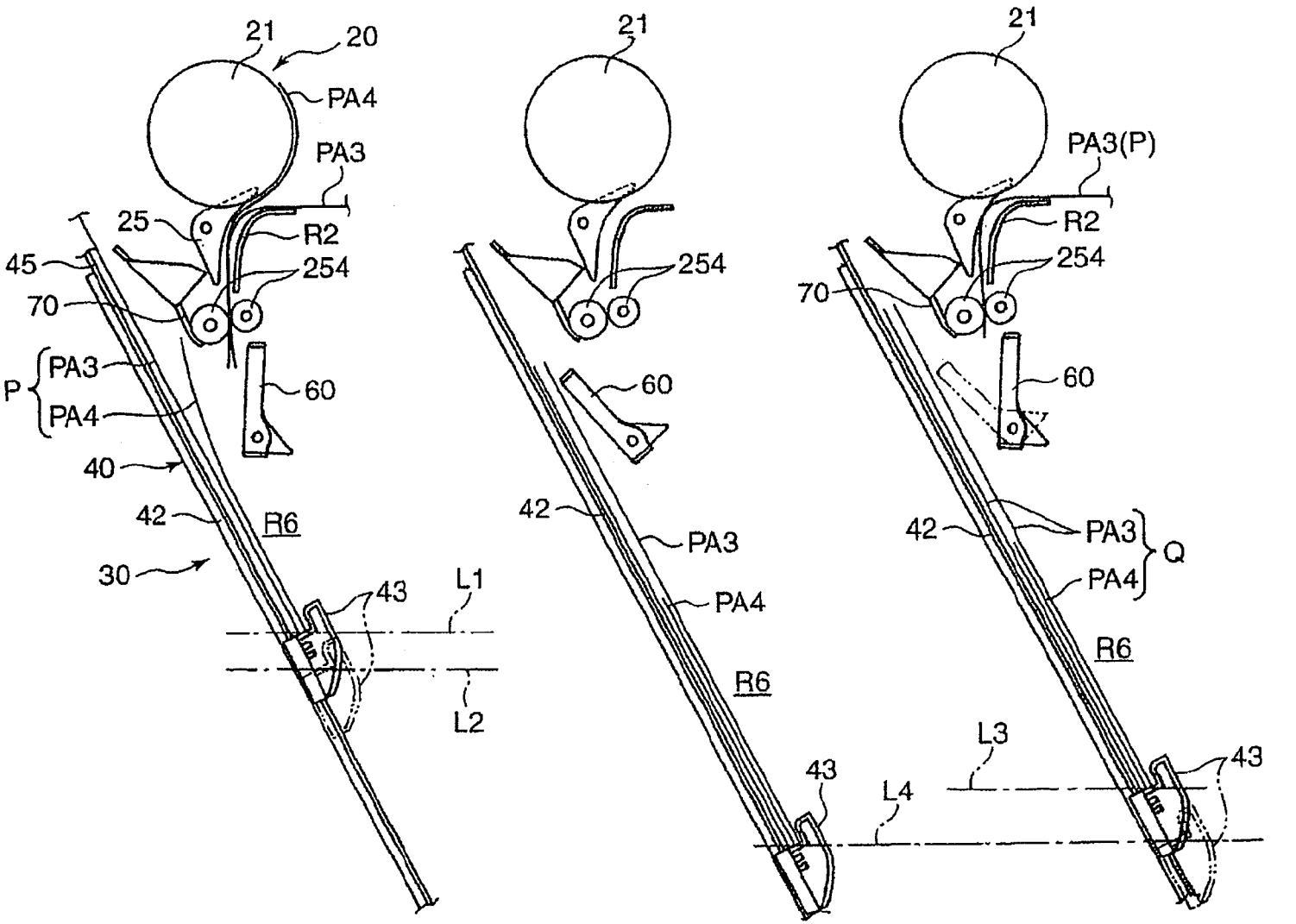
FIG. 5A-FIG. 5C are explanatory diagrams showing an example of a paper alignment method for a stacking unit, wherein (A) shows the condition immediately prior to when an A4 paper is detoured to a paper detour retaining device and then introduced to the stacking unit together with an A3 paper which was sent next from the image forming device, (B) shows the condition where an A3 paper which is being introduced to the stacking unit is biased toward a paper receiving plate by a biasing member, and (C) shows the condition where a paper bundle which is supported by a paper lifting and lowering member is aligned.

Next, a paper alignment method for the stacking unit 30 which does not cause a reduction in processing efficiency of the image forming process of the image forming device 19 by means of detouring the A4 paper PA4 to the paper detour retaining device 20 in this manner will be described in further detail based on FIG. 5A-FIG. 5C. FIG. 5A-FIG. 5C are explanatory diagrams showing an example of the paper alignment method for the stacking unit 30, wherein (A) shows the condition immediately prior to when an A4 paper PA4 is detoured to the paper detour retaining device 20 and then introduced to the stacking unit 30 together with an A3 paper PA3 which was sent next from the image forming device 19, (B) shows the condition where an A3 paper PA3 which is being introduced to the stacking unit 30 is biased toward a paper receiving plate 42 by a biasing member 60, and (C) shows the condition where a paper bundle Q which is supported by a paper lifting and lowering member 43 is aligned.

First, in the condition shown in FIG. 5A, one sheet of A3 paper PA3 and one sheet of A4 paper PA4 are stored while being supported by the paper lifting and lowering member 43 on a paper receiving plate 42 of the receiving unit 40 of the stacking unit 30. When an A4 paper PA4 is overlaid by an A3 paper PA3, these papers P will be received by the paper lifting and lowering member 43 shown by the solid line in the A4 receiving position L1 shown by the single dot broken line, and then the paper lifting and lowering member 43 will drop to the A4 alignment position L2 shown by the single dot broken line L2, and alignment is performed by the impact of the sudden stop and the subsequent return back to the A4 receiving position L1. In this condition, the A4 paper PA4 will be pushed to the left side position as shown in FIG. 5A-FIG. 5C of the position retaining member 70 by being biased by the biasing member 60, and thereby will not interfere with the paper P fed through the second transport roller pair 254 to the stacking unit internal transport path R6, and therefore the pages will be orderly.

Furthermore, FIG. 5A shows the condition where the A4 paper PA4 which had earlier been detoured to the detour drum 21 is overlaid and merged with the A3 paper PA3 which was sent from the image forming device 19 (FIG. 1) through the punching unit 12 by the rotation in the clockwise direction of the detour drum 21 in the common tray transport path R2, and is introduced through the second transport roller pair 254 to the stacking unit internal transport path R6. These papers PA3, PA4 which have been merged together in the common tray transport path R2 will pass between the A4 paper PA4 previously stored in the stacking unit internal transport path R6 and the biasing member 60 which has been set to a standing position, and be supported by the paper lifting and lowering member 43 which is in the A4 receiving position L1.

Next, as shown in FIG. 5B, the paper lifting and lowering member 43 will be lowered to an A3 alignment position L4 for aligning A3 paper PA3 which is set to a position lower than the A4 alignment position L2, and at the same time, the A3 paper PA3 will be biased towards the paper receiving plate 42 by the biasing member 60 which changes position from a standing position to an incline position which inclines towards the paper receiving plate 42, and thereby the top edge of the A3 paper PA3 will be pushed to the left side position as shown in FIG. 5A-FIG. 5C of the second transport roller pair 254.

As shown in FIG. 5C, in this condition, the paper lifting and lowering member 43 will be lifted to the A3 paper receiving position L3 from the A3 paper alignment position L4. At this time, the biasing member 60 is set to the incline position shown by the double dotted broken line shown in FIG. 5C, so the top edge of the A3 paper PA3 will be positioned between the position retaining member 70 and the paper receiving plate 42, and therefore interference with the next paper P introduced to the stacking unit internal transport path R6 can be avoided.

Next, as shown by the solid line in FIG. 5A-FIG. 5C, the biasing member 60 will change position to the standing position, and in this condition, the next A3 paper PA3 will be fed through the common tray transport path R2, the second transport roller pair 254, and the biasing member 60 into the stacking unit internal transport path R6 and will be received by the paper lifting and lowering member 43 positioned in the A3 receiving position L3. Furthermore, hereafter if A3 paper PA3 is continuously introduced to the receiving unit 40, alignment will be performed by the paper lifting and lowering member 43 repeatedly lifting and lowering between the A3 receiving position L3 and the A3 alignment position L4.

In contrast, when an A4 paper PA4 page, which is sent between two A3 paper PA3 pages, is fed to the stacking unit internal transport path R6, the A4 paper PA4 will be temporarily detoured to the detour drum 21 by switching the position of the intake unit switching guide 25 from the stacking unit target position Z6 to the common tray target position Z5, and will be combined with the following A3 paper PA3 and fed together to the stacking unit internal transport path R6.

In this manner, when post-processing a paper bundle Q of mixed sizes, when A4 paper PA4 is fed to the stacking unit 30, the A4 paper PA4 will be temporarily detoured to the detour drum 21 under predetermined conditions, and will be combined with the following A3 paper PA3 and fed to the stacking unit internal transport path R6, so the feed pitch of the paper P successively fed from the image forming device 19 does not need to be delayed, and a reduction in the processing efficiency of the image forming process can be prevented.

On the other hand, if the A4 paper PA4 is not detoured, the paper lifting and lowering member 43 which was positioned in the A3 alignment position L4 must temporarily be raised to the A4 alignment position L2 prior to the A4 paper PA4 entering the stacking unit internal transport path R6, and therefore the feed pitch of the paper P from the image forming device 19 will need to be delayed because of the additional time required.

Furthermore, the paper bundle Q comprising a plurality of sheets of paper P which have been fed to the stacking unit internal transport path R6 will be aligned while being supported by the paper lifting and lowering member 43, or in other words based on the leading edge side of the paper P and the transport direction, and therefore if alignment is to be performed based on a region other than the leading edge side in the direction of paper transport, the alignment process can be relatively easily performed.

Figure 6:
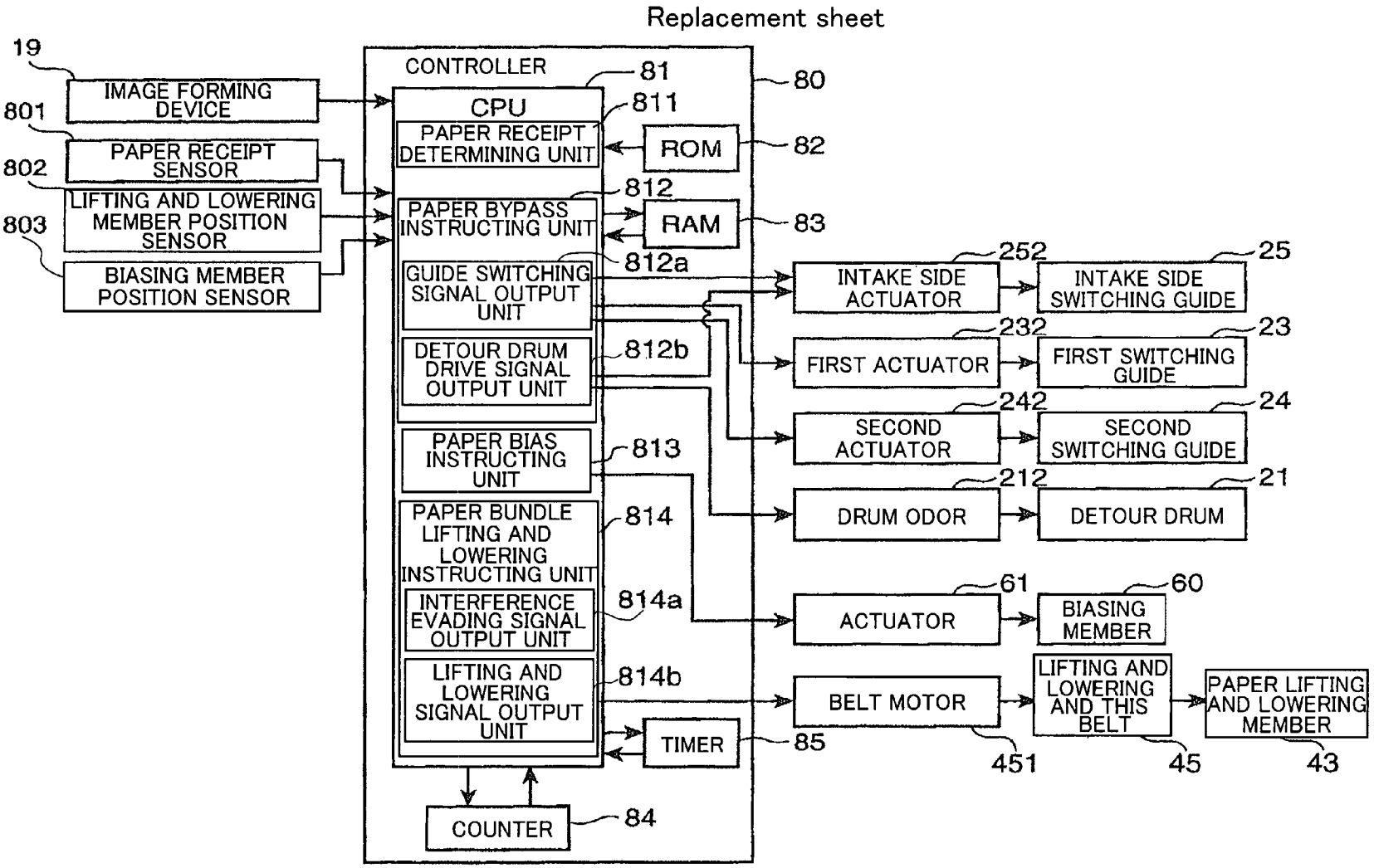
FIG. 6 is a block diagram showing an example of paper alignment control by the controlling unit of a post-processing device.

Next, the paper alignment process control using the paper post-processing device 10 will be described based on FIG. 6. FIG. 6 is a block diagram showing an example of the paper alignment processing control using the controller of the paper post-processing device 10. As shown in FIG. 6, the controller 80 has a basic construction comprising a central processing unit CPU 81, read-only ROM 82 attached to the CPU 81, and readable writable RAM 83.

The ROM 82 stores a program for executing this control, and when the power is turned on to the paper post-processing device 10, the program is read by the CPU 81. On the other hand, the RAM 83 is used for temporarily reading and writing the data necessary for control, and for instance records the size of the paper P currently to be discharged to the stacking unit internal transport path R6 (A3 paper PA3 or A4 paper PA4 or the like) and the size of the previous paper P, and the memory content is updated to the latest condition as discharging of the paper proceeds.

The CPU 81 is equipped with a paper receipt determining unit 811, a paper bypass instructing unit 812, a paper bias instructing unit 813, and a paper bundle lifting and lowering instructing unit 814. A counter 84 for individually counting the number of papers P discharged to the stacking unit internal transport path R6 in a single job and a timer 85 for timing as necessary are established separate from the CPU 81.

The paper receipt determining unit 811 outputs a predetermined signal to the paper bias instructing unit 813 and the paper bundle lifting and lowering instructing unit 814 each time a paper P passes through the stacking unit transport path R5. For this purpose, a paper receipt sensor 801 (FIG. 1) for detecting when a paper P has been transferred from the discharge paper port 191 to the paper post-processing device 10 is established at an appropriate location along the intake side transport path R1 (as close as possible to the paper receiving opening 111 side), and a detection signal is input to the paper receipt determining unit 811 each time a paper is detected by the paper receipt sensor 801. The paper receipt determining unit 811 determines that a paper P has been received by the paper post-processing device 10 each time a detection signal is input, and outputs a signal to that effect to the paper bypass instructing unit 812, the paper bias instructing unit 813, and the paper bundle lifting and lowering instructing unit 814.

Furthermore, the paper receipt determining unit 811 is able to determine the size (length) of the paper P based on the detection signal from the paper receipt sensor 801. Specifically, the controller 80 has a timer 84, and the time lapse from the moment the leading edge of the paper P is detected until the trailing edge is detected is measured, and the paper receipt determining unit 811 calculates the length of the paper P from the time lapse obtained, and determines whether the paper P is a short paper (A4 paper PA4 in this embodiment) Ps or a long paper (A3 paper PA3 in this embodiment).

The paper bypass instructing unit 812 is equipped with a detour drum drive signal output unit 812*b* and a guide switching signal output unit 812*a*, and confirms that a paper P has been received by the paper post-processing device 10 from the image forming device 19, and the type of paper P (in this embodiment whether the paper P is an A3 paper PA3 or an A4 paper PA4) received, using the signal from the paper receipt determining unit 811, then determines whether to detour the paper P to the paper detour retaining device 20 based on the size and condition of the paper P, and based on the results of that determination, outputs a predetermined control signal.

If the paper P currently sent from the image forming device 19 to the paper post-processing device 10 is A4 paper PA4 and predetermined conditions are met, the guide switching signal output unit 812*a* outputs a signal to the intake side actuator 252, first actuator 232, and second actuator 242 (specifically the solenoids which make up the actuators) that the A4 paper PA4 is to be detoured to the ring transport path R3 formed on the circumferential surface of the detour drum 21, and because of this control signal, the intake unit switching guide 25 is set to the common tray target position Z5 (FIG. 2), the first switching guide 23 is set to the ring transport path target position Z2, and the second switching guide 24 is set to the stacking unit target position Z6.

By setting the position of these guides 25, 23, 24, the A4 paper PA4 fed from the image forming device 19 through the punching unit 12 will be sent to the ring transport path R3, and will be detoured and held by the paper detour retaining device 20 while wrapped approximately one time around the detour drum 21.

Furthermore, in this embodiment, three conditions are used as the conditions for the A4 paper PA4 being detoured to the paper detour retaining device 20, namely:

(a) the first A4 paper PA4 when the first paper P is an A4 paper PA4;

(b) the next A4 paper PA4 when the order of paper in a set is an A3 paper PA3 followed by an A4 paper PA4; and (c) the first two pages of A4 paper PA4 when a plurality of pages (two pages in this embodiment) of A4 paper PA4 are followed by an A3 paper PA3.

The reason for using condition (a) is that when the paper bundle Q is different, stapling will be performed on the paper bundle Q after the final paper P in the previous paper bundle Q is held in the stacking unit 30 and then the stapled paper bundle Q will be discharged from the stacking unit 30, but the time required for these operations exceeds the processing pitch of the image forming process of the image forming device 19, and therefore the first A4 paper PA4 of the next paper bundle Q will be detoured to the paper detour retaining device 20. Incidentally, if the first page of the next paper bundle Q is an A3 paper PA3, the A3 paper PA3 will not be detoured, but this is because the holding capacity of the detour drum 21 is matched to A4 paper PA4.

Furthermore, the reason for using condition (b) is to cause the A4 paper PA4 to detour in order to avoid the problem where when the paper lifting and lowering member 43 is set to the A3 receiving position L3 (FIG. 5A-FIG. 5C), the next A4 paper PA4 cannot be received by the paper lifting and lowering member 43 so the paper lifting and lowering member 43 must temporarily be raised to the A3 receiving position L3 (FIG. 5A-FIG. 5C), and the feed pitch for the paper sent from the image forming device 19 must be delayed because of this time loss.

Furthermore, the reason for using condition (c)is that there is no need to make a difference between the two sheets of paper PA4 which precede the A3 paper PA3 with regards to combining with the A3 paper PA3, and therefore these two sheets of A4 paper PA4 may simultaneously be combined with the A3 paper PA3.

The detour drum drive signal output unit 812b outputs a control signal to the intake side actuator 252 and the drum motor 212 in order to discharge the paper which has been detoured and retained in the paper detour retaining device 20 to the stacking unit 30.

Furthermore, the intake unit switching guide 25 which has been set to the stacking unit target position Z6 by the control signal output from the intake side actuator 252 will change position to the common tray target position Z5 by being driven by the intake side actuator 252, and in this condition, the paper P, which has been wrapped around the detour drum 21 by the clockwise rotation of the detour drum 21 which is driven by the drum motor 212, will be guided by the intake unit switching guide 25 and the fed through the stacking unit transport path R5 to the stacking unit 30 by means of the second transport roller pair 254 and the biasing member 60.

After receiving the detection signal from the paper receipt sensor 801, the paper bias instructing unit 813 outputs a control signal to the biasing actuator 61 (FIG. 4) which drives the biasing member 60 to change the paper biasing position of the biasing member 60, which has been set in the paper receiving position, after the paper lifting and lowering member 43 has been lowered from the upper position to the lower position (shown by the double dotted broken line in FIG. 5A for instance), but when the paper lifting and lowering member 43 which has been set to the lower position changes position to the upper position, the paper bias instructing unit 813 will output a control signal to the biasing actuator 61 to change the position of the biasing member 60 to the original paper receiving position (refer to the biasing member 60 shown by the double dotted broken line in FIG. 5C for instance).

A lifting and lowering member position sensor 802 is established in an appropriate location in order to operate the biasing member 60 in this manner (in the example shown in FIG. 4, the lifting and lowering member position sensor 802 is established in proximity to the belt motor 451, and can determine the height of the paper lifting and lowering member 43 by detecting the rotation of the belt motor 451). Furthermore, the detection signal of the lifting and lowering member position sensor 802 is temporarily input to the paper receipt determining unit 811, and the signal based on these determination results is output to the paper bias instructing unit 813. The paper bias instructing unit 813 which has received the signal will output a control signal to the biasing actuator 61 to change the position of the biasing member 60.

After the biasing member 60 has change position from the paper receiving position to the paper biasing position, the paper lifting and lowering instructing unit 814 outputs a motor drive control signal to the belt motor 451. Therefore a biasing member position sensor 803 (FIG. 4) is established in proximity to the biasing member 60 to detect whether the biasing member 60 is in the paper receiving position or the paper biasing position. Furthermore, when a detection signal is received from the biasing member position sensor 803 which has detected that the biasing member 60 has been set to the paper biasing position, the paper receipt determining unit 811 outputs a signal expressing that fact to the paper bundle lifting and lowering instructing unit 814.

Therefore, the paper bundle lifting and lowering instructing unit 814 which has received the signal will output a control signal to the belt motor 451 to raise the paper lifting and lowering member 43 a predetermined distance by means of the lifting and lowering endless belt 45, and outputs to the belt motor 451 a control signal to lower the paper lifting lowering member 43 to the lower position by setting the biasing member 60 to the paper receiving position.

Furthermore, in this embodiment in particular, and interference evading signal output unit 814*a* and a lifting and lowering signal output unit 814*b* are established in the paper bundle lifting and lowering instructing unit 814, and the division of operations is based on the type of signal that was output.

The interference evading signal output unit 814*a* outputs an interference evading signal to the belt motor 451 to set a position which corresponds to the size of the previous paper P which is stored in the stacking unit internal transport path R6 prior to the next paper P which will be supplied to the stacking unit internal transport path R6 and which is the upper position (either A4 receiving position L1 or A3 receiving position L3) specific to that paper P, which was set in order to prevent interference between the trailing edge of the prior paper P and the next paper P. Therefore, the belt motor 451 which has received the signal will move the paper lifting and lowering member 43 in conjunction with the biasing member 60 (in other words, with the front surface plate 62 of the biasing member 60 applying a bias to the previous paper P) to the upper position by driving the lifting and lowering endless belt 45, and therefore the next paper P will be discharged to the stacking unit internal transport path R6 appropriately without interfering with the previous paper.

The lifting and lowering signal output unit 814*b* outputs a lifting and lowering signal to the belt motor 451 to move the paper lifting and lowering member 43 to the lower position which corresponds to the size of the next paper P, which was received by the stacking unit internal transport path R6 without interfering with the previous paper P, because the paper lifting and lowering member 43 was set to the upper position specific for the previous paper P by the signal from the interference evading signal output unit 814*a*. Therefore, even if the next paper P is a different size than the previous paper P for instance, the next paper P will not interfere with the previous paper P and will be supported properly by the paper lifting and lowering member 43 which is set at the level of the paper receiving position specific to the next paper.

Furthermore, with the present embodiment, the controller 80 has a counter 84, and the counter 84 counts the number of pages each time that the paper receipt sensor 801 detects paper P, while at the same time the number of pages of paper P discharged from the image forming device 19 to the paper post-processing device 10 is input to the CPU 81. When the number of pages counted by the counter 84 matches the number of page information from the image forming device 19, the paper receipt determining unit 811 outputs to the paper bias instructing unit 813 a signal for the biasing member 60 to return to the initial condition (FIG. 5A or FIG. 5C) and outputs to the paper bundle lifting and lowering instructing member 814 a signal to the the paper lifting and lowering member 43 to raise up close to the second transport roller pair 254. Thereby the paper bundle P1 which has been aligned in the stacking unit internal transport path R6 will be discharged through the common tray transport path R4 to the common tray 15. Next, the paper lifting and lowering member 43 will return to the initial position (shown by the solid line in FIG. 5A or FIG. 5C for instance), in preparation for the paper P of the next job. Furthermore, the counter 84 will be cleared when one job is completed.

Figure 7:
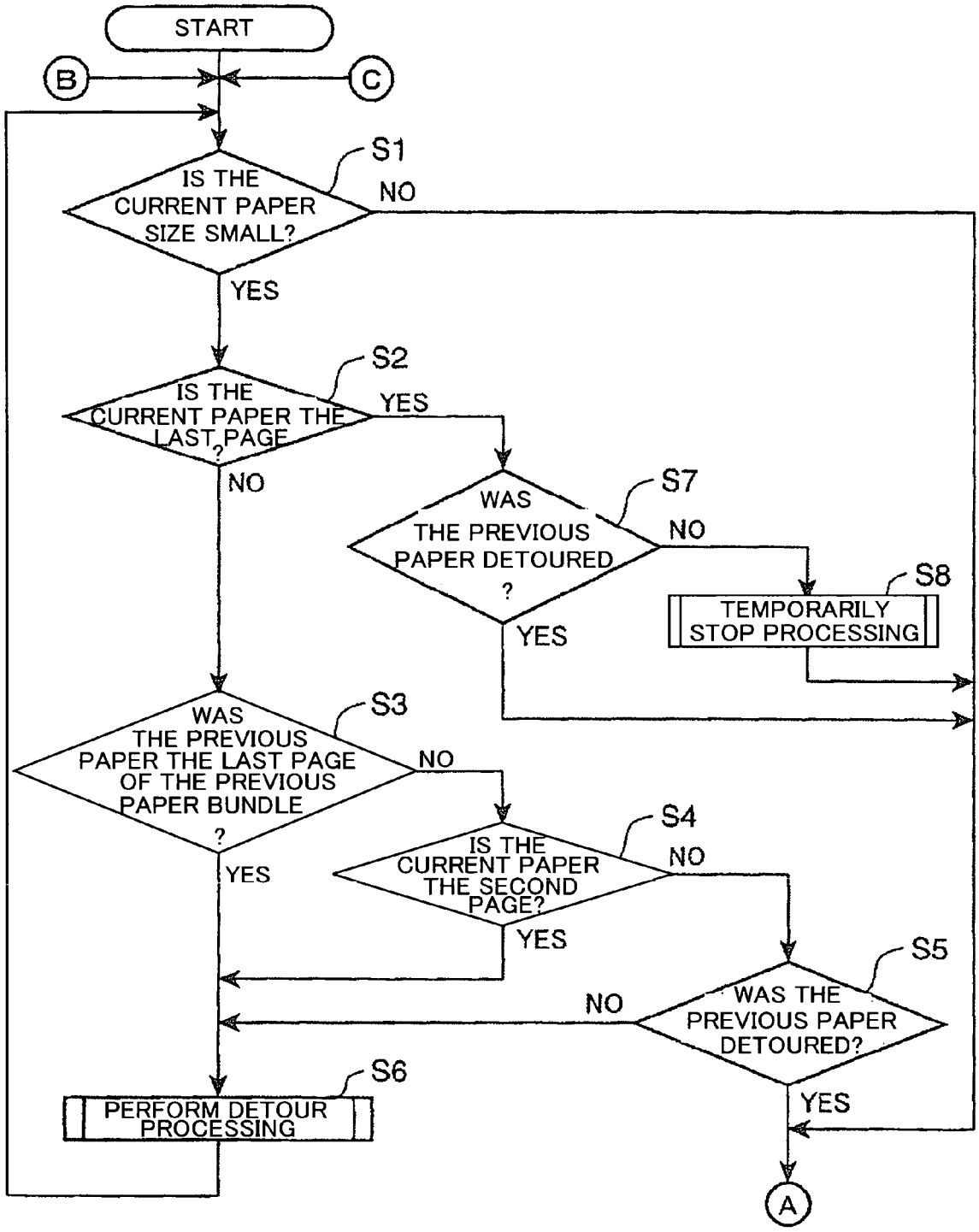
FIG. 7 is a flowchart showing an example of detour control flow for paper P showing the first half of the flowchart.
Figure 8:
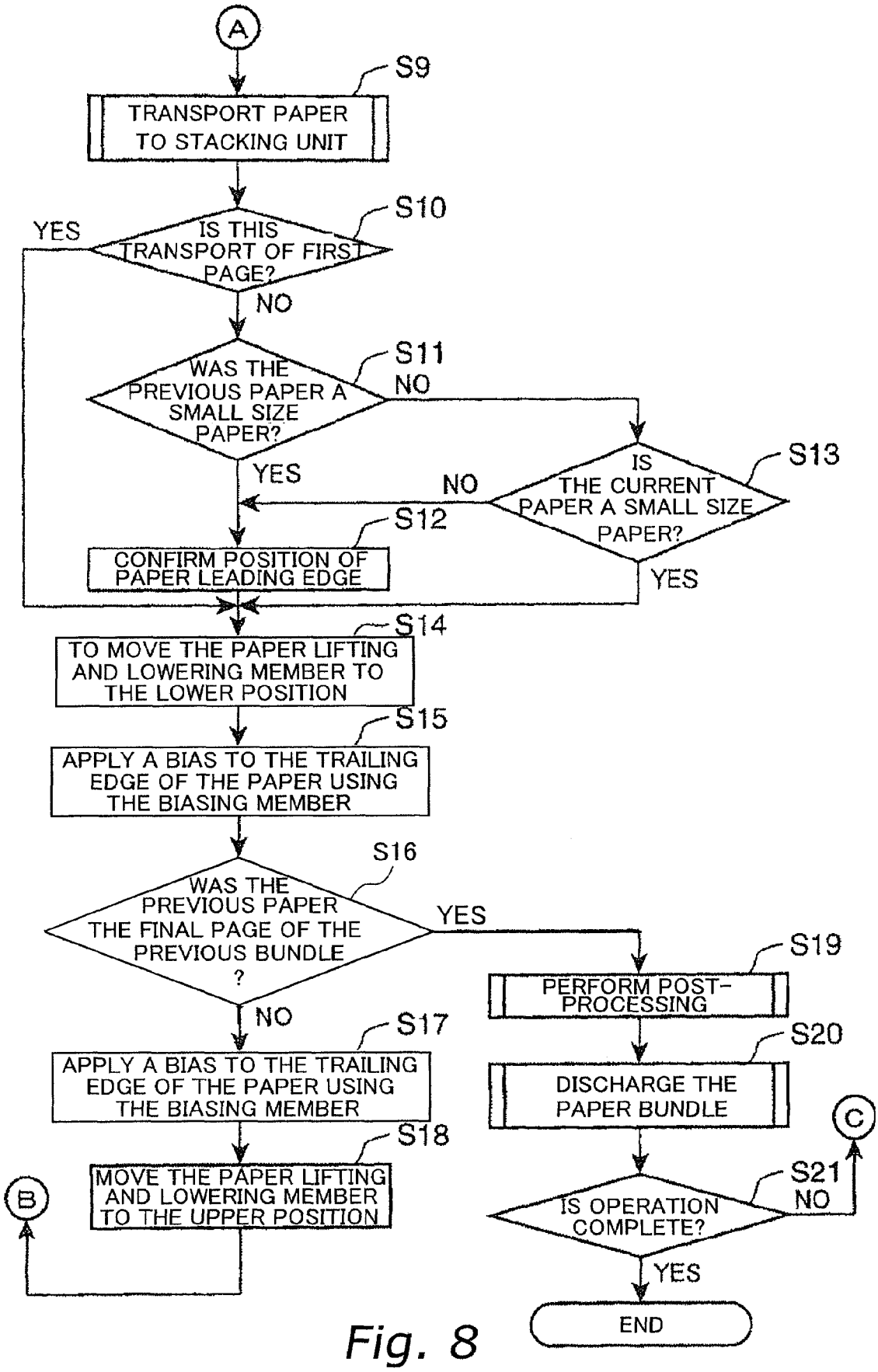
FIG. 8 is a flowchart showing an example of detour control flow for paper P showing the second half of the flowchart.

The control flow for detouring paper P to the paper detour retaining device 20 will be described next based on FIG. 7 and FIG. 8. FIG. 7 and FIG. 8 are flow charts showing an example of the control flow for detouring paper P. Incidentally, FIG. 7 shows the first half of the flowchart and FIG. 8 shows the second half of the flowchart. This flowchart begins when the paper P is introduced to the paper post-processing device 10 from the paper postprocessing device 10. First, in step S1, the paper currently transferred to the paper post-processing device 10 (referred to as the current paper) is identified as to whether it is a small size paper (A4 paper PA4 in the present embodiment) or not, and if the paper P is a small size (YES in step S1), a decision will be made as to whether the current paper P is the last page (last paper) of one paper bundle Q (one set) (step S2). This determination is made by comparing the number of pages of the paper bundle Q input from the image forming device 19 and the number of pages counted by the counter 84.

Furthermore, if the current paper is not the last page (NO in step S2), a determination is made as to whether or not the paper P fed to the paper post-processing device 10 prior to the current paper P (referred to as the prior paper P) was the last page of the previous paper bundle Q (step S3), and if the previous paper P was the last page, or in other words, if the current paper P is the first paper P of the current paper bundle Q (YES in step S3) then the flow will skip to step S6 and the current paper will be detoured to the detour drum 21.

In contrast, if the answer in step S3 is NO, (or in other words if the previous paper P was not the last page of the previous paper bundle Q), a determination is made as to whether the current paper P is the second page in the current paper bundle Q (step S4). If the current paper P is the second page (YES in step S4), then the small size paper P will be detour to the detour drum 21. However, if the current paper P is not the second page (NO in step S4), a determination is made as to whether or not the previous paper P has been detoured or not (step S5). If the previous paper P has not been detoured (NO in step S5), step S6 will be performed and the current paper P will be detoured to the detour drum 21. If the previous paper P has been detoured (YES in step S5), then step S9, where the paper P is introduced to the stacking unit 30, and subsequent steps will be performed.

Furthermore, if the current paper is determined to not be a small size in step S1, (in other words the current paper is a large size paper (A3 paper PA3 in this embodiment) (NO in step S1)), then the process will skip to step S9.

Furthermore, if the current paper P (small size paper P) is determined to be the last page in step S2 (YES in step S2), then a determination is made in step S7 as to whether or not the previous paper P was detoured. If the previous paper was detoured (YES in step S7), the flow will skip to step S9, but if not detoured (NO in step S7), or in other words if a small size paper is the last page in the current paper bundle Q, the flow will skip to step S9 after stopping temporarily.

Step S9 is the step where the paper P sent from the image forming device 19 is fed into the stacking unit 30, and if a paper P has already been detoured to the paper detour retaining device 20 (or in other words the detour drum 21), those papers will be combined and begin to be fed to the stacking unit 30.

Furthermore, when the paper P begins to be fed to the stacking unit 30, step S10 will promptly be executed and determination will be made as to whether the paper P is the first page of the current paper bundle Q. If the paper P is the first page (YES in step S10), then the flow will skip to step S14, but if not the first page, a determination will be made as to whether or not the previous paper P was a small size paper (step S11). If the previous paper P was a small size paper (YES in step S11), then the position of the leading edge of the paper P will be confirmed (step S12) and then step S14 will be performed.

In contrast, if the previous paper P is determined not to be a small size in step S11 (in other words the paper P is a large size) (NO in step S11), then a determination is made as to whether or not the current paper P is a small size (step S13). If the current paper P is a small size (YES in step S13), then step S14 will promptly be executed, but if the size is not small (or in other words if the paper P is a large size), then step S14 will be executed after the position of the leading edge of the paper P is confirmed (step S12).

Step S14 is the step where the paper lifting and lowering member 43 is moved to the lower position (A4 alignment position L2 if the paper P is A4 paper PA4 (FIG. 5A-FIG. 5C), or A3 alignment position L4 if the paper P is A3 paper PA3).

Furthermore, if the paper lifting and lowering member 43 is set to the lower position by the execution of step S14, the biasing member 60 will bias the trailing edge of the paper P, which is being fed to the stacking unit 30, to the paper receiving plates 42 (step S15). Next, a determination is made as to whether or not the current paper is the last page of the paper bundle Q (step S16). If the current paper is not the last page (NO in step S17), the biasing member 60 will again bias the trailing end of the paper P (step S17), and then the paper lifting and lowering member 43 will be moved to the upper position (A4 receiving position L1 if the paper P is A4 paper PA4 (FIG. 5A-FIG. 5C) or A3 receiving position L3 if the paper P is A3 paper PA3), returning to step S1 for the next paper P.

In contrast, if the current paper P is determined in step S16 to be the last page (YES in step S16), then the predetermined post-processing will be performed (stapling) (step S19), the paper bundle Q will be discharged (step S20), and a determination will be made as to whether or not the operation is complete for other subsequent paper bundles Q (step S21). If completed (YES in step S21), the series of post-processing will be completed, but if not completed (NO in step S21), then the flow will return to step SI for another paper bundle Q.

As described above, the paper alignment device of the present embodiment performs alignment on a paper bundle Q consisting of a mixture of a predetermined number of A4 paper PA4 as small size paper and A3 paper PA3 as large size paper, formed by successively receiving paper sent from the image forming device 19, and the paper alignment device comprises a stacking unit 30 as the main retaining device which retains paper P in an aligned and stacked condition which has been successively fed from the image forming device 19, a paper detour retaining device 20 established directly upstream from the stacking unit 30 as a preliminary retaining device which temporarily retains the paper P which has been sent to the stacking unit 30, and a controller 80 which performs control such that the A4 paper PA4 is temporarily retained, and the retained A4 paper PA4 is combined with the following A3 paper PA3 and fed together to the stacking unit 30.

By using this construction, even if a single paper bundle Q is a so-called mixed size bundle consisting of a mixture of A4 paper PA4 and A3 paper PA3, the A4 paper PA4 will be temporarily retained by the paper detour retaining device 20 and then combined with the A3 paper PA3 and sent in a overlaid condition to the stacking unit 30, and therefore the conventional problem can be eliminated which occurs when paper P of different sizes are separately sent to the stacking unit 30 such that receiving preparations for the size must be made and the paper feed pitch of the image forming device 19 must be delayed to make up for the lost time. For instance, even if a single paper bundle Q is a mixed size bundle, the paper P can be fed at the preset pitch specific to the image forming device 19, and thereby the processing capacity of the image forming device 19 does not need to be reduced.

Furthermore, the paper P fed to the stacking unit 30 is aligned based on the leading edge in the transport direction while supported by the paper lifting and lowering member 43 as a paper receiver, and therefore even if paper P of different sizes are fed to the stacking unit 30 for instance, alignment can be performed by the up and down rocking motion of the paper lifting and lowering member 43, and if alignment is performed based on a part other than the leading edge in the transport direction of paper P, the alignment process can be performed relatively easily and accurately.

Furthermore, the paper detour retaining device 20 is equipped with a detour drum 21 as a ring shaped member which retains the paper P along the circumferential surface, and therefore paper P which has been temporarily retained in the paper detour retaining device 20 can be returned to the original transport path without reversing transport direction by circling one time along the circumferential surface of the detour drum 21, and compared to the case where the transport direction is reversed to return to the original position, the equipment costs can be made that much less expensive because a structure for transporting backwards is not necessary.

Furthermore, the paper post-processing device 10 of the present invention is constructed with a paper alignment device of this construction built-in, so the functional effects of the paper alignment device can be fully achieved. Furthermore, the paper post-processing device 10 has a paper receipt sensor 801 as a size sensor for detecting the size of the paper independent of the image forming device 19, and therefore the size of the paper P can be detected on the paper post-processing device 10 side without that information being input from the image forming device 19 and the signal communication system can be simplified because acquiring many signals from the image forming device 19 will not be necessary.

The present invention is not restricted to the above embodiment, and may also include the following content.

(1) In the above embodiment, an example of A4 paper PA4 as the short paper and A3 paper PA3 as the long paper was described, but the present invention is not restricted to cases where the short paper is A4 paper PA4 and the long paper is A3 paper PA3, and alternatively the short paper may be B5 paper and the long paper may be B4 paper, or a combination of A series size paper and B series size paper may be used.

(2) In the above embodiment, the detour drum 21 had an outer circumferential surface with a circumference which matched the length in the short direction of the A4 paper PA4, and therefore only A4 paper PA4 which is transported in the portrait orientation (orientation where the short side is parallel to the direction of paper transport) can be detoured to the detour drum 21, but the present embodiment is not restricted to the case where the circumference of the detour drum 21 is set to this length, and a circumference which can accommodate landscape oriented (orientation where the long side is parallel to the direction of paper transport) A3 paper PA3 may also be used. Thereby the degrees of freedom for detouring paper can be increased.

(3) In the above embodiment, the paper detour retaining device 20 as the preliminary retaining device was constructed with a detour drum 21 which retains the paper P on the circumferential surface, but the present invention is not restricted to cases where the preliminary retaining device is constructed as a paper detour retaining device 20 with a detour drum 21, and alternately, a linear detour tray may be established and after the paper P has been detoured to this detour tray, the paper P may be combined with the next paper P using a switchback system and then fed to the stacking unit 30.

What is claimed is:

1. A paper alignment device. that aligns first size paper and second size paper being larger than the first size paper into a bundle of paper fed from an upstream device, comprising:

a size sensor detecting paper size of paper fed from the upstream device;

a main retaining device having a paper receiving unit contactable to an end of the paper being fed and retaining in a stacked condition the bundle of paper;

a preliminary retaining device located in a paper transfer direction upstream of the main retaining device, the preliminary retaining device temporarily retaining only first size paper destined to the main retaining device; and a control unit causing the first size paper in the preliminary retaining device to be retained when fed under a predetermined condition, and causing feeding to the main retaining device of the first size paper retained in the preliminary retaining device together with successively fed second size paper, the predetermined condition being realized when a first size paper is fed subsequent to a first fed sheet of paper being a second size paper.

2. The paper alignment device as set forth in claim 1, wherein the main retaining device retains in a housing of the paper aligment device in a stacked condition the bundle of paper, and the bundle of paper has the first size paper and the second size paper, the second size paper being larger than the first.

3. A paper post-processing device for successively receiving paper fed from an upstream device and performing predetermined post-processing, comprising:

a housing; and a paper alignment device according to claim 2.

4. The paper alignment device set forth in claim 2,wherein the control unit further includes a paper bypass instructing unit that determines whether to cause paper to be retained by the preliminary retaining device or to be sent to the main retaining device, depending on the type and condition of the paper, and that outputs a control signal to a designated switching means that switches the destination of the paper.

5. A paper alignment device. that aligns first size paper and second size paper being larger than the first size paper into a bundle of paper fed from an upstream device, comprising:

a size sensor detecting paper size of paper fed from the upstream device;

a main retaining device having a paper receiving unit contactable to an end of the paper being fed and retaining in a stacked condition the bundle of paper;

a preliminary retaining device located in a paper transfer direction upstream of the main retaining device, the preliminary retaining device temporarily retaining only first size paper destined to the main retaining device; and a control unit causing the first size paper in the preliminary retaining device to be retained when fed under a predetermined condition, and causing feeding to the main retaining device of the first size paper retained in the preliminary retaining device together with successively fed second size paper, the predetermined condition realized when a plurality of first fed sheets of paper is a first size paper and are followed by a second size paper.

6. The paper aligmnent device as set forth in claim 5, wherein the main retaining device retains in a housing of the paper alignment device in a stacked condition the bundle of paper, and the bundle of paper has the first size paper and the second size paper, the second size paper being larger than the first.

7. A paper post-processing device for successively receiving paper fed from an upstream device and performing predetermined post-processing, comprising:

a housing; and a paper alignment device according to claim 6.

8. The paper alignment device set forth in claim 6 wherein the control unit further includes a paper bypass instructing unit that determines whether to cause paper to be retained by the preliminary retaining device or to be sent to the main retaining device, depending on the type and condition of the paper, and that outputs a control signal to a designated switching means that switches the destination of the paper.

9. A paper alignment device. that aligns first size paper and second size paper being larger than the first size paper into a bundle of paper fed from an upstream device, comprising:

a size sensor detecting paper size of paper fed from the upstream device;

a main retaining device having a paper receiving unit contactable to an end of the paper being fed and retaining in a stacked condition the bundle of paper;

a preliminary retaining device located in a paper transfer direction upstream of the main retaining device, the preliminary retaining device temporarily retaining only first size paper destined to the main retaining device and a control unit causing the first size paper in the preliminary retaining device to be retained when fed under a predetermined condition, and causing feeding to the main retaining device of the first size paper retained in the preliminary retaining device together with successively fed second size paper, the preliminary retaining including a cylindrical detour drum that-has having a ring transport path formed on a periphery thereof, an arc shaped cover partially covering the cylindrical detour drum, a first switching guide being configured to switch the path of paper to and away from a part of the ring transport path, and a second switching guide being located downstream of the first switching guide and upstream of the arc shaped cover, the second switching guide being configured to switch that-s-witches the path of paper to and away from a second part of the ring transport path.

10. The paper alignment device as set forth in claim 9, wherein the main retaining device retains in a housing of the paper alignment device in a stacked condition the bundle of paper, and the bundle of paper has the first size paper and the second size paper, the second size paper being larger than the first.

11. A paper post-processing device for successively receiving paper fed from an upstream device and performing predetermined post-processing, comprising:

a housing; and a paper alignment device according to claim 10.

12. The paper alignment device set forth in claim 10 wherein the control unit further includes a paper bypass instructing unit that determines whether to cause paper to be retained by the preliminary retaining device or to be sent to the main retaining device, depending on the type and condition of the paper, and that outputs a control signal to a designated switching means that switches the destination of the paper.

* * * * *